US011467526B2

(12) United States Patent
Ishikawa et al.

(10) Patent No.: US 11,467,526 B2
(45) Date of Patent: Oct. 11, 2022

(54) LOCK MECHANISM OF DRAWER UNIT PROVIDED IN IMAGE FORMING APPARATUS

(71) Applicant: CANON KABUSHIKI KAISHA, Tokyo (JP)

(72) Inventors: Naoki Ishikawa, Chiba (JP); Teruhiko Suzuki, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 42 days.

(21) Appl. No.: 17/189,413

(22) Filed: Mar. 2, 2021

(65) Prior Publication Data

US 2021/0286308 A1 Sep. 16, 2021

(30) Foreign Application Priority Data

Mar. 13, 2020 (JP) ..... JP2020-044388

(51) Int. Cl.
*G03G 15/00* (2006.01)
*G03G 21/16* (2006.01)

(52) U.S. Cl.
CPC ..... *G03G 15/70* (2013.01); *G03G 15/5004* (2013.01); *G03G 15/80* (2013.01); *G03G 21/1633* (2013.01); *G03G 21/1638* (2013.01); *G03G 2215/00548* (2013.01); *G03G 2221/1654* (2013.01); *G03G 2221/1675* (2013.01)

(58) Field of Classification Search
CPC .... G03G 15/70; G03G 15/80; G03G 21/1633; G03G 21/1638; G03G 2215/0548; G03G 2221/1654; G03G 2221/1675; G03G 2221/169; G03G 15/5004
See application file for complete search history.

(56) References Cited

U.S. PATENT DOCUMENTS

| | | | | |
|---|---|---|---|---|
| 5,134,443 | A * | 7/1992 | Sumi | G03G 15/6558 399/121 |
| 8,508,770 | B2 * | 8/2013 | Lee | G03G 21/1652 358/1.14 |
| 9,176,462 | B2 * | 11/2015 | Ohta | G03G 21/1638 |
| 10,167,166 | B2 * | 1/2019 | Kakitani | B65H 7/06 |
| 10,203,645 | B2 * | 2/2019 | Iino | G03G 15/502 |
| 10,466,639 | B2 * | 11/2019 | Kanno | G03G 21/1638 |
| 10,732,560 | B2 | 8/2020 | Suzuki | |
| 10,842,019 | B2 | 11/2020 | Shinotsuka et al. | |
| 10,969,721 | B2 * | 4/2021 | Honda | G03G 21/1638 |

FOREIGN PATENT DOCUMENTS

| | | |
|---|---|---|
| JP | 2001272892 A | 10/2001 |
| JP | 2014134753 A | 7/2014 |

OTHER PUBLICATIONS

U.S. Appl. No. 17/190,527, filed Mar. 3, 2021.

* cited by examiner

*Primary Examiner* — Justin N Olamit
(74) *Attorney, Agent, or Firm* — Venable LLP

(57) ABSTRACT

When a sheet jam is detected, a processor may perform the following process. In a case where a sheet is spanning a first conveyance path and a drawer unit, the processor maintains a lock unit in a locked state by supplying power to the lock unit via the drawer unit from a power supply without depending on whether a door is in an open state or a closed state. In a case where a sheet is not spanning the first conveyance path and the drawer unit, the processor controls supplying and disconnecting of power to the drawer unit from the power supply in accordance with whether the door is in a closed state or an open state.

13 Claims, 11 Drawing Sheets

FIG. 6

600

DRAWER UNIT LOCK CONDITION TABLE

| S1 | S2 | S3 | S4 | S5 | S6 | S7 | S8 | S9 | S10 | PROCESSING |
|---|---|---|---|---|---|---|---|---|---|---|
| — | — | — | SHEET IS PRESENT | SHEET IS PRESENT | — | — | — | — | — | LOCKED |
| — | — | — | — | — | — | — | SHEET IS PRESENT | SHEET IS PRESENT | — | LOCKED |

— : SHEET IS PRESENT OR SHEET IS NOT PRESENT

1003

REMOTE SIGNAL

| | | LOCK STATE | |
|---|---|---|---|
| | | UNLOCKED | LOCKED |
| COVER SENSOR | CLOSED | ON | ON |
| | OPEN | OFF | ON |

LOCK MECHANISM OF DRAWER UNIT PROVIDED IN IMAGE FORMING APPARATUS

BACKGROUND OF THE INVENTION

Field of the Invention

The present invention relates to a lock mechanism of a drawer unit provided in an image forming apparatus.

Description of the Related Art

If a sheet supplied to an image apparatus is a sheet that is not envisioned to be used in that image forming apparatus by design, or a conveyance roller is worn, a sheet jam may occur. When a jam occurs, a user must manually remove the sheet remaining in a conveyance path. Image forming apparatuses may have a maintenance door and a drawer unit. The maintenance door is opened when removing a jammed sheet or when replacing consumables. The drawer unit forms a portion of the conveyance path and is pulled out for maintenance of a fixing device and the like.

In U.S. Pat. No. 9,176,462, a lock mechanism for prohibiting pulling out of a drawer unit in a case where there is a sheet spanning the drawer unit and the conveyance path is proposed. By this, tearing of the sheet is prevented. According to Japanese Patent Laid-Open No 2001-272892, avoiding hot swapping by disconnecting supply of power to the drawer unit when a door is opened is proposed.

Conventionally, a lock mechanism of a drawer unit and a mechanism for avoiding hot swapping could not be concurrently achieved. This is because, when a door is opened, supply of power to the drawer unit is disconnected in order to avoid hot swapping, which then disengages an electronic lock mechanism.

SUMMARY OF THE INVENTION

The present invention provides an image forming apparatus comprising: a first conveyance path configured to convey a sheet; a drawer unit including a second conveyance path for conveying the sheet, after the sheet is handed over from the first conveyance path, and configured to be able to be pulled out; a power supply configured to supply power to the drawer unit; a door configured to be able to be opened/closed; a lock unit which is provided in the drawer unit, which has a locked state in which pulling out of the drawer unit is prohibited in a case where a sheet is spanning the first conveyance path and the drawer unit and an unlocked state in which pulling out of the drawer unit is permitted in a case where a sheet is not spanning the first conveyance path and the drawer unit, and which is configured to maintain the locked state using power supplied to the drawer unit from the power supply, and which is configured not to maintain the locked state when the supply of the power is disconnected; a jam sensor configured to detect a sheet jam; and a processor configured to, when the sheet jam is detected, in a case where a sheet is spanning the first conveyance path and the drawer unit, without depending on whether the boor is in an open state or a closed state, maintain the lock unit in the locked state by supplying power to the lock unit via the drawer unit from the power supply, and in a case where a sheet is not spanning the first conveyance path and the drawer unit, control supplying and disconnecting of power to the drawer unit from the power supply in accordance with whether the door is in a closed state or an open state.

Further features of the present intention will become apparent front the following description of exemplary embodiments (with reference to the attached drawings).

BRIEF DESCRIPTION OF THE DRAWINGS

FIG. 6 is a view describing a control table.

DESCRIPTION OF THE EMBODIMENTS

Figure 1:
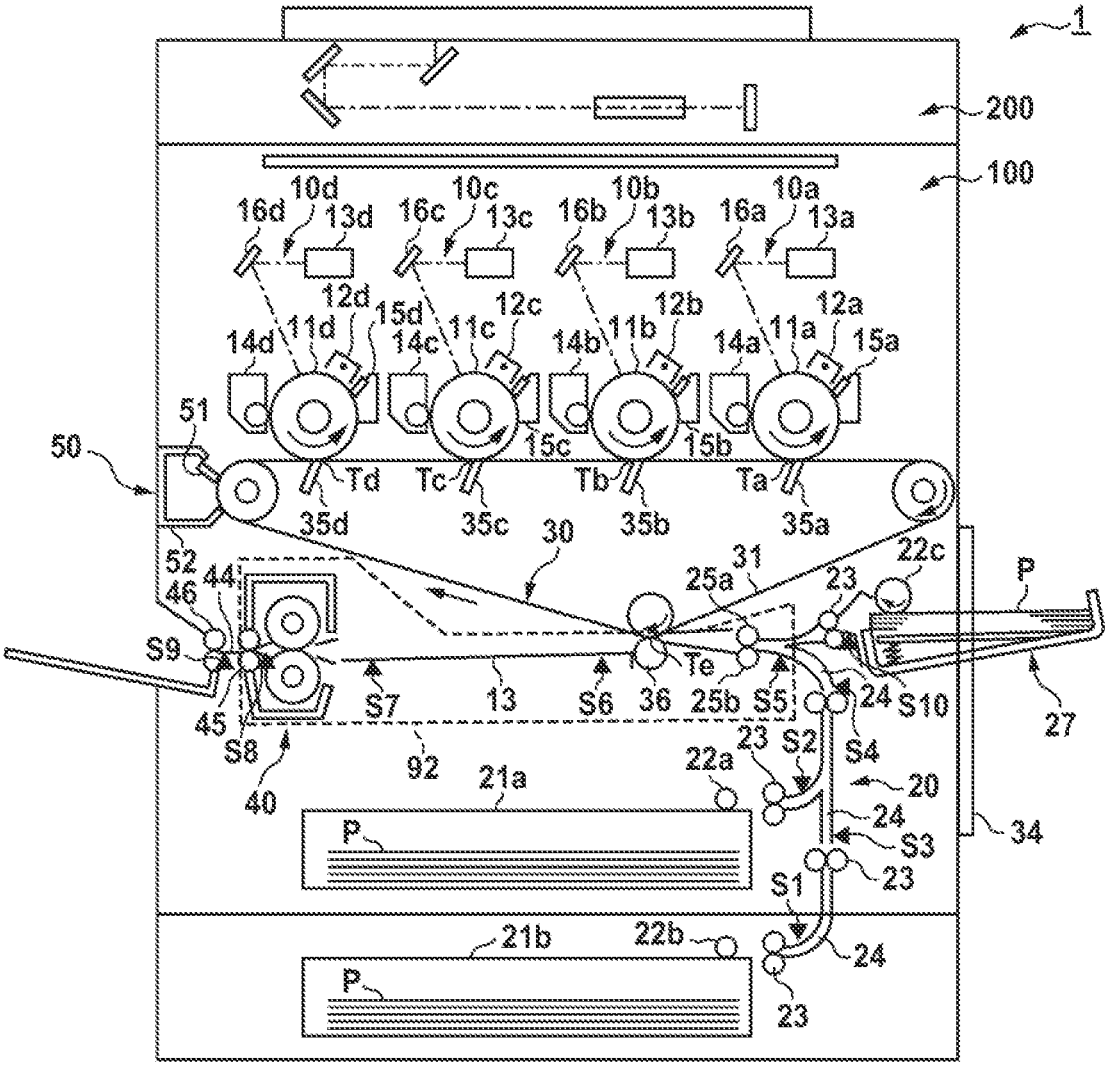
FIG. 1 is a cross-sectional view of an image forming apparatus.

Hereinafter, embodiments will be described in detail with reference to the attached drawings. Note, the following embodiments are not intended to limit the scope of the claimed invention. Multiple features are described in the embodiments, but limitation is not made an invention that requires all such features, and multiple such features may be combined as appropriate. Furthermore, in the attached drawings, the same reference numerals are given to the same or similar configurations, and redundant description thereof is omitted.

Image Forming Apparatus

As illustrated in FIG. 1, an image forming apparatus 1 is an electrographic image forming apparatus for forming monochrome images and full color images using four image forming units 10, each for a different color. At the end of reference numerals indicating the same or similar parts, lowercase alphabets are provided. When common matters are described, the lowercase alphabet letters may be omitted.

A printer unit 100, has the image forming units 10, a sheet feeding unit 20, an intermediate transfer unit 30, and a fixing unit 40. In the image forming units 10, photosensitive drums 11 are image carrying members that carry electrostatic latent images and toner images. Charge devices 12 uniformly charge the surfaces of the photosensitive drums 11. Optical systems 13 are exposure apparatuses for forming electrostatic latent images by radiating to the photosensitive drums 11 light via reversion mirrors 16. Development apparatuses 14 develop the electrostatic latent images into the toner images using toner. Colors of toner are any of yellow, cyan, magenta, and black, for example. Primary transfer rollers 35 transfer, in primary transfer regions T, the toner images onto an intermediate transfer belt 31 of the intermediate transfer unit 30 from the photosensitive drums 11. Drum cleaners 15 clean the toner remaining on the photosensitive drums 11. The intermediate transfer belt 31 conveys, while rotating, the toner images to a secondary transfer region Te. Secondary transfer rollers 36, in the secondary transfer region Te, transfers the toner images from the intermediate transfer belt 31 to a sheet P. A cleaning blade 51 of a belt cleaner 50 cleans and then collects in a collected toner box 52 the toner remaining on the intermediate transfer belt 31. A conveyance path 43 conveys the sheet P to the fixing unit 40 from the secondary transfer region Te. The fixing unit 40 fixes onto the sheet P the toner images using heat and pressure. Conveyance rollers 45 and 46 discharge out the sheet P along a conveyance path 44.

The sheet feeding unit 20 has sheet cassettes 21*a* and 21*b* and a manual tray 27 for storing the sheets P. Pickup rollers 22 pick up and then feed to a conveyance path 24 a sheet P stored in the sheet cassettes 21. Conveyance rollers 23 convey to a downstream side along the conveyance path 24 and then transfer to registration rollers 25 the sheet P. Similarly, a pickup roller 22*c* picks up and then feeds to the conveyance path 24 a sheet P stacked in the manual tray 27. The conveyance rollers 23 transfer the sheet P to the registration rollers 25. The registration rollers 25 convey the sheet P to the secondary transfer region Te so that a timing at which the toner images arrive at the secondary transfer region Te and a timing at which the sheet P arrives at the secondary transfer region Te coincide.

The conveyance paths 24, 43, and 44 have a conveyance guide for smoothing conveyance of the sheet P. In the conveyance paths 24, 43, and 44, sheet sensors S1 to S10 are provided. The sheet sensors S1 to S10 are used for detecting a jam of the sheet P are used for managing a conveyance timing of the sheet P, for example.

On the right side surface of the image forming apparatus 1, a door 34 is provided. A worker, by opening the door 34, can remove the sheet P jammed in a conveyance path. In particular, the sheet P that stopped while spanning the conveyance path 24 and a drawer unit 92 is removed by opening the door 34.

Drawer Unit

The drawer unit 92 is a part that can be pulled out from the image forming apparatus 1. The drawer unit 92 has the registration rollers 25, the secondary transfer rollers 36, the conveyance path 43, and the fixing unit 40. A user or a maintenance person, by pulling out the drawer unit 92, performs jam processing or maintains the registration rollers 25, the secondary transfer rollers 36, the conveyance path 43, and the fixing unit 40.

In FIG. 1, the conveyance path 24 exists from the sheet cassettes 21*a* and 21*b* and the manual tray 27 to an entrance of the drawer unit 92. The conveyance path 43 exists from the entrance to an exit of the drawer unit 92. The conveyance path 44 exists from the exit of the drawer unit 92 to the outside of the image forming apparatus 1.

Figure 2A:
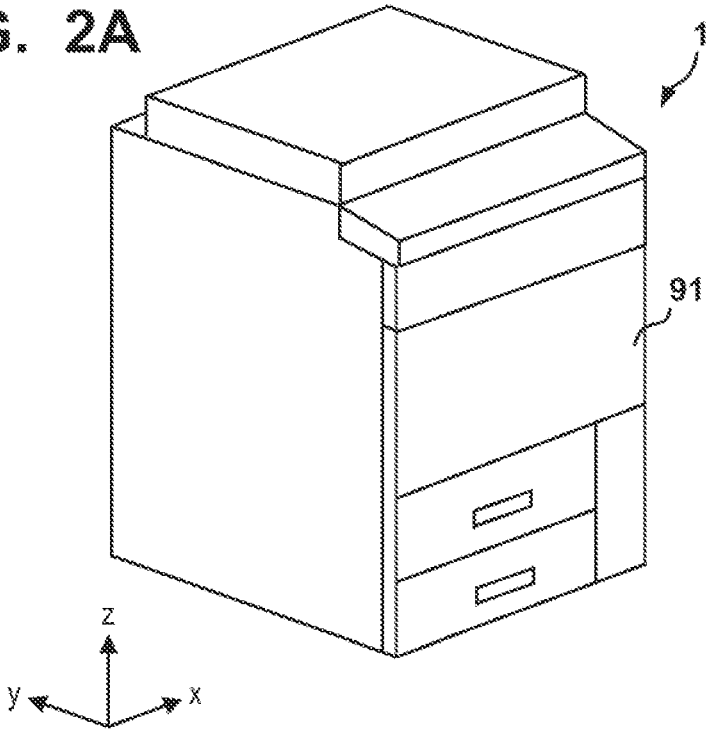
FIGS. 2A and 2B are views describing a drawer unit.
Figure 2B:
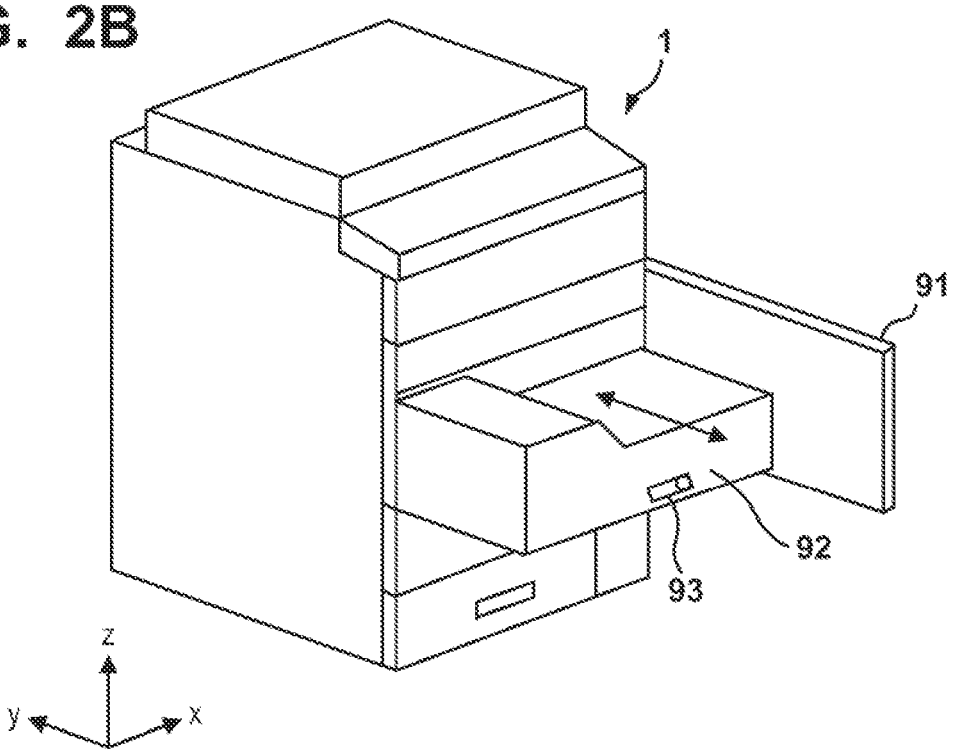

As described by FIG. 2A and FIG. 2B, a front cover 91 is provided on a front side of the image forming apparatus 1. The front cover 91 is a type of a door. The front cover 91 is opened when the maintenance person accesses the drawer unit 92. In this example, a hinge is provided on a right side of the front cover 91.

The drawer unit 92 has a lever 93 that can be rotated about a rotation axis parallel to a y-axis. The maintenance person unlocks, by rotating the lever 93, the drawer unit 92 (disengages a lock) and then pulls out the drawer unit 92. In FIG. 2A and FIG. 2B, a height direction of the image forming apparatus 1 is defined as a z-axis direction, and a depth direction is defined as a y-direction, and a widthwise direction is defined as an x-direction.

Drawer Lock Mechanism

Figure 3A:
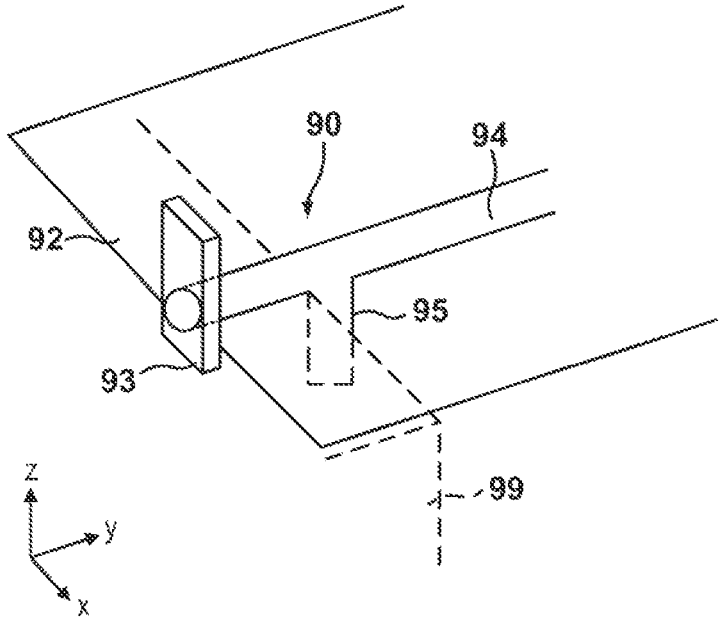
FIGS. 3A to 3D are views describing a drawer lock mechanism.
Figure 3B:
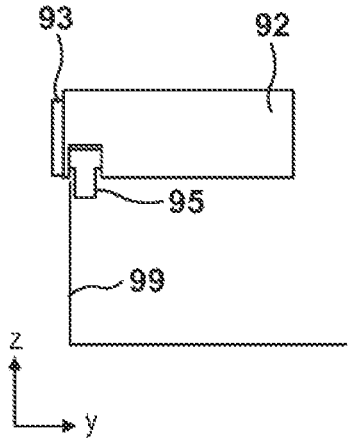
Figure 3C:
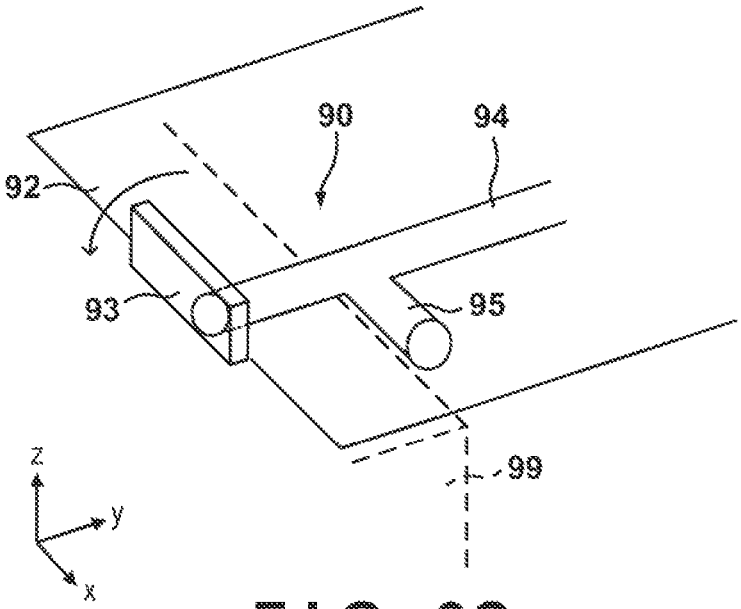

FIG. 3A illustrates a lock mechanism of the drawer unit 92. A drawer lock mechanism 90 has the lever 93, a rotation axis 94, a projecting portion 95 and a main body frame 99. The lever 93 is attached to an end of the rotation axis 94 and can be rotated as illustrated in FIG. 3C. FIG. 3A and FIG. 3B illustrate a locked state. In the locked state, the end of the projecting portion 95 faces a downward direction and a side surface of the projecting portion 95 contacts the main body frame 99. In other words, because the side surface of the projecting portion 95 collides with the main body frame 99, an operator cannot pull out the drawer unit 92.

Figure 3D:
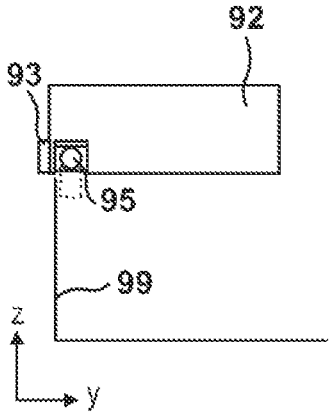

As illustrated in FIG. 3C, when the lever 93 is rotated in a counter-clockwise direction, the projecting portion 95 is also rotated via the rotation axis 94. As illustrated in FIG. 3D, when the projecting portion 95 is mostly horizontal, the projecting portion 95 cannot contact the main body frame 99. Accordingly, the drawer lock mechanism 90 enters an unlocked state, and the operator can pull out the drawer unit 92.

Lever Lock Mechanism

Figure 4A:
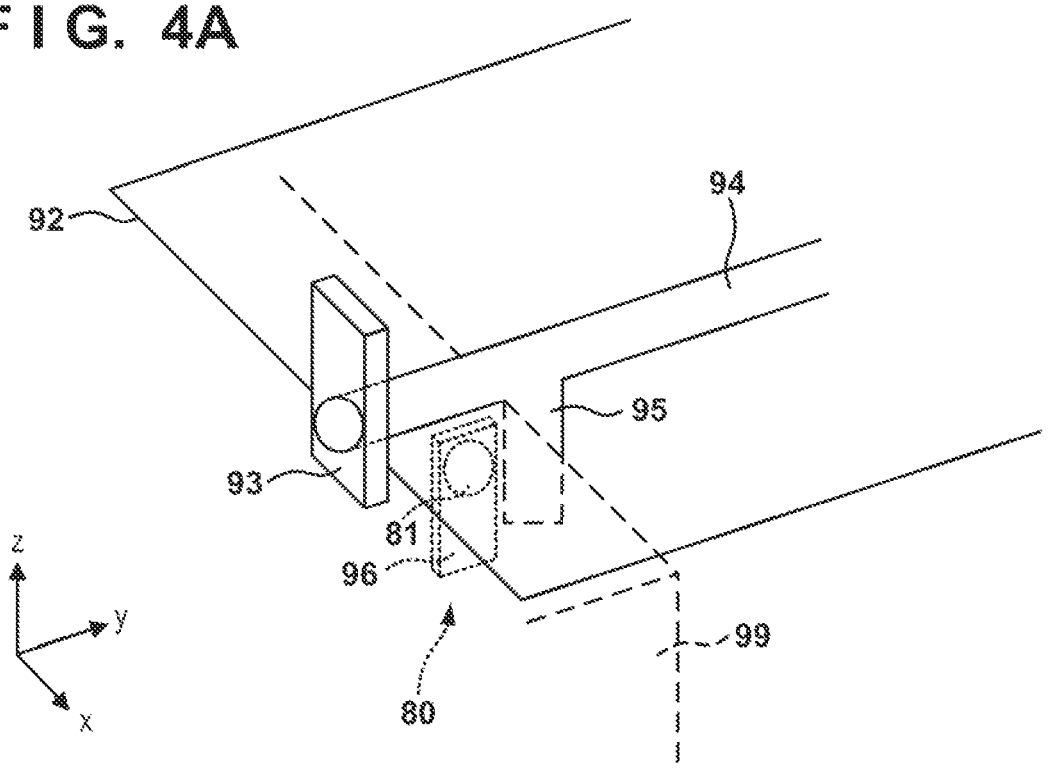
FIGS. 4A and 4B are views describing a lever lock mechanism.
Figure 4B:
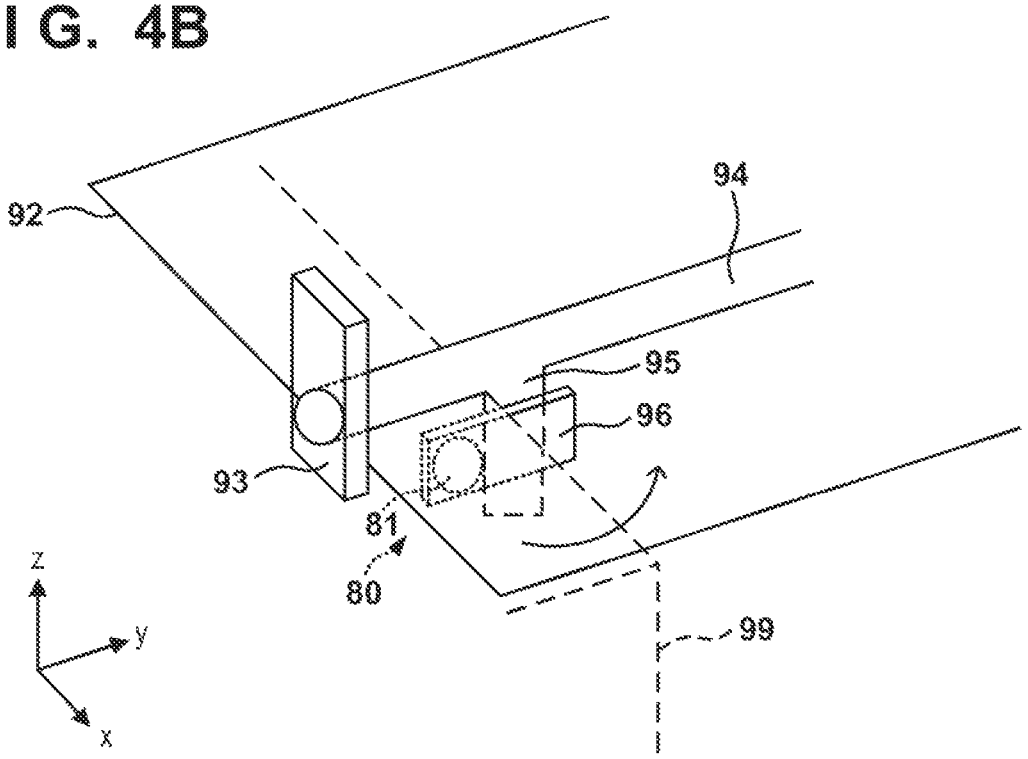

FIG. 4A and FIG. 4B illustrate a lever lock mechanism 80. As illustrated in FIG. 4A and FIG. 4B, a lock member 96 is provided to be able to rotate about a rotation axis 81 which is parallel to an x-axis. FIG. 4A indicates that the lever lock mechanism 80 is in the unlocked state. The lock member 96 faces the downward direction and does not contact the projecting portion 95. Accordingly, the lever 93, the rotation axis 94, and the projecting portion 95 can rotate in the counter-clockwise direction. FIG. 4B indicates that the lever lock mechanism 80 is in the locked state. By an actuator, such as a solenoid, or a torsion spring to be described later, the lock member 96 is rotated to be mostly horizontal. Because in this state, the projecting portion 95 is interfered with by the lock member 96, the lever 93 cannot be rotated, and the drawer lock mechanism 90 is maintained in a locked state.

Controller

Figure 5:
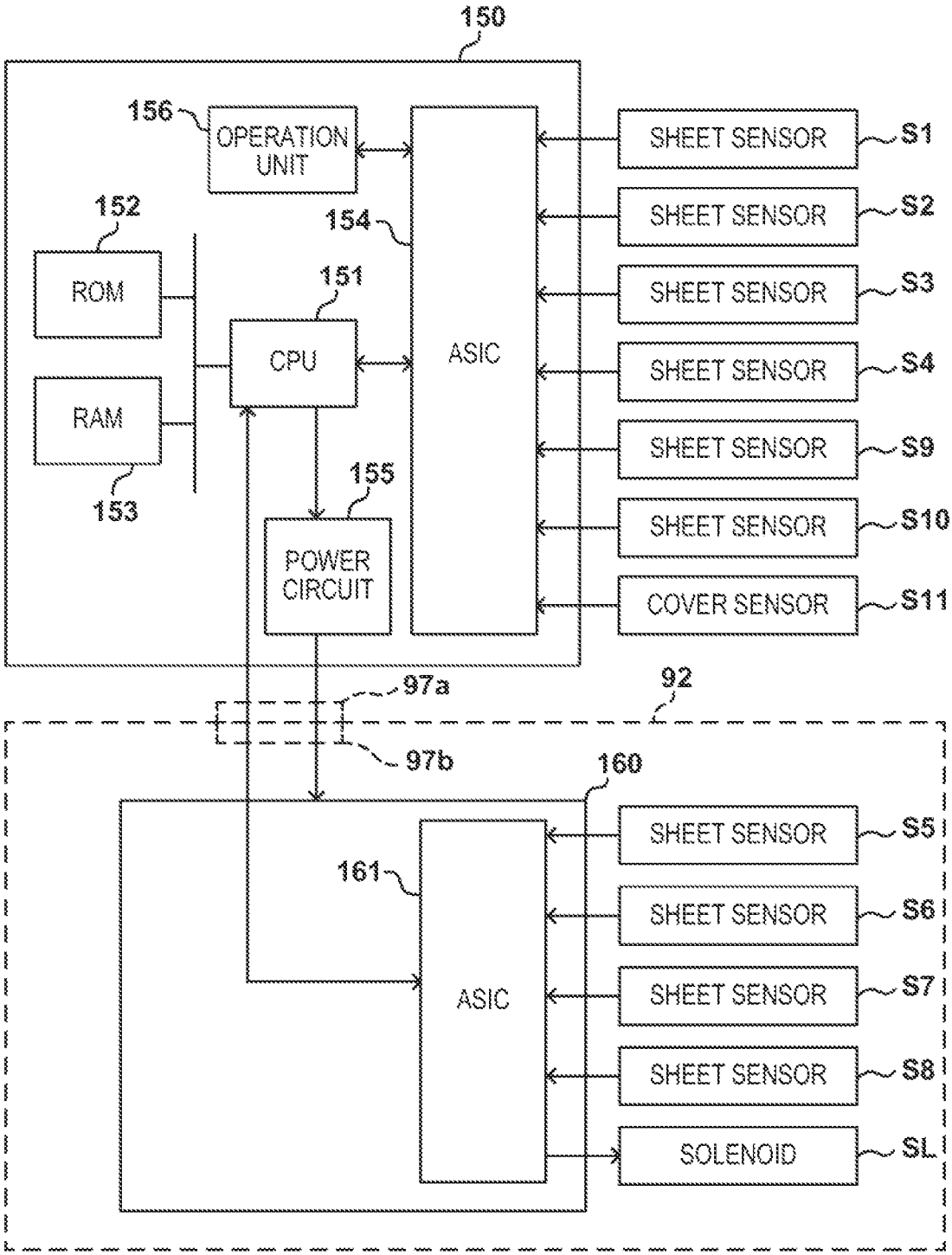
FIG. 5 is a view illustrating a controller.

FIG. 5 illustrates a controller that controls the image forming apparatus 1. The printer unit 100 has control substrates 150 and 160. The control substrate 160 is positioned in the drawer unit 92. Thus, the control substrate 150 and the control substrate 160 are connected via drawer connectors 97 (97*a* and 97*b*).

The control substrate 150 has a CPU 151, a ROM 152, and a RAM 153. The CPU 151 is connected by a bus line in relation to the ROM 152 and the RAM 153 and communicates via the bus line. The CPU 151 executes an instruction based on a control program stored in the ROM 152. The control substrate 150 has an ASIC 154 that functions as an input circuit of the sheet sensors S1 to S4, S9, and S10 and a cover sensor S11. The ASIC 154 converts detection signals outputted from these sensors into detection signals that can be inputted into the CPU 151. A power circuit 155 supplies power to the control substrate 160 via the drawer connectors 97. The cover sensor S11 is a sensor that detects at least one of an open state and a closed state of the front cover 91.

The control substrate 160 has an ASIC 161. The CPU 151 is connected via a serial line to the ASIC 154 and the ASIC 161. The CPU 151 communicates with the ASIC 154 and the ASIC 161 via the serial line.

In the drawer unit 92, the sheet sensors S5, S6, S7, and S8 are provided. The ASIC 161 functions as an input circuit of the sheet sensors S5, S6, S7, and S8. The ASIC 161 converts detection signals outputted from these sensors into detection signals that can be inputted into the CPU 151. In the drawer unit 92, a solenoid SL for rotating the lock member 96 is provided. The CPU 151 transmits an instruction to the ASIC 161 to turn the solenoid SL on and off. The ASIC 161 turns the solenoid SL on and off in accordance with the instruction received from the CPU 151.

The CPU 151 decides a position of the sheet P based on a result of detection by the sheet sensors S1 to S10. Alternatively, the CPU 151, when the sheet sensor S1 detects a leading edge of the sheet P, uses a timer or a counter circuit to measure a conveyance tinge of the sheet P. Even when a threshold time decided based on a length and a conveyance speed of the sheet P has elapsed, there are cases where the sheet sensor S1 is not be able to detect a trailing edge of the sheet P. In such a case, the CPU 151 determines that a jam of the sheet P has occurred at a detection position of the sheet sensor S1. The CPU 151 executes the same jam detection for the respective sheet sensors S2 to S10. The CPU 151, when a jam is detected, stops all rotating members except for the conveyance rollers that are further on the downstream side than the conveyance rollers that correspond to a position of the jam to interrupt image formation. When sheets that were being conveyed further to the downstream side than the conveyance rollers that correspond to the position of the jam are discharged, the conveyance rollers on the downstream side are also stopped. In such a case, one or more sheets P may remain in the conveyance paths 24, 43, and 44. The CPU 151 causes an operation unit 156 to display that a jam has occurred and a message prompting to remove the jammed sheet. When all remaining sheets P are removed by the user, the CPU 151 resumes image formation. Note that an operation for the user or the maintenance person to remove the sheet P may be called jam resolution processing.

Control of Solenoid

The CPU 151 detects a jam of the sheet P based on a result of detection by the sheet sensors S1 to S10 and then notifies the user that jamming has occurred via the operation unit 156. The CPU 151, in a case where the sheet P could be torn if the drawer unit 92 is pulled out, makes so that the drawer unit 92 cannot be pulled out.

In the jam resolution processing, there are two cases where the sheet P could be torn. The first case is a case where the sheet P spans the conveyance path 24 and the drawer unit 92 (conveyance path 43). The second case is a case where the sheet P spans the conveyance path 44 and the drawer unit 92 (conveyance path 43).

FIG. 6 illustrates a control table 600 that holds conditions for controlling the lever 93 into the locked state. The control table 600 is stored in the ROM 152 and is used by being read out by the CPU 151. In this example, it is defined that in a ease where the sheet sensor S4 and the sheet sensor S5 both detect a sheet, the lever 93 is controlled into the locked state. Similarly, it is defined that in a case where the sheet sensor S8 and the sheet sensor S9 both detect a sheet, the lever 93 is controlled into the locked state.

Figure 7:
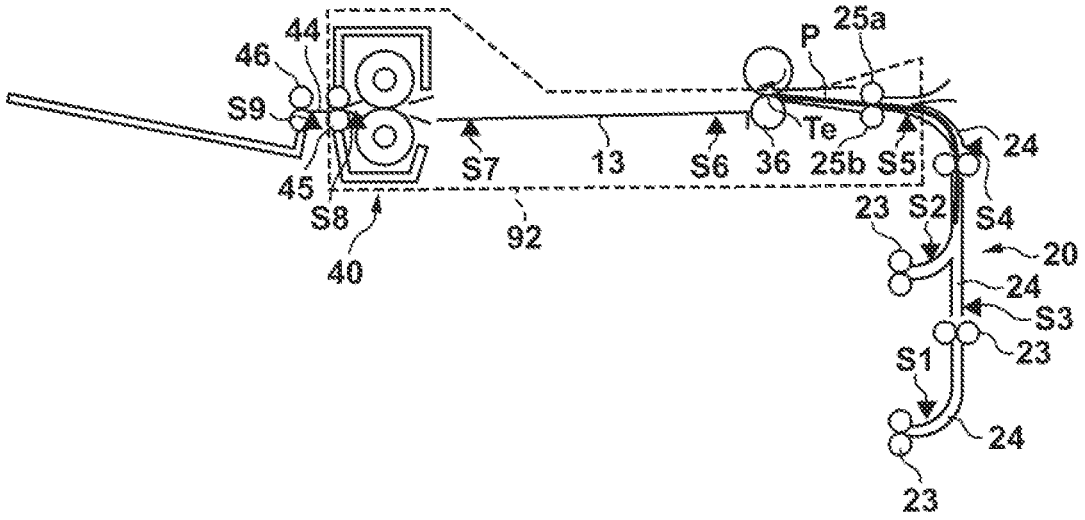
FIG. 7 is a view for describing spanning of a sheet.

As illustrated in FIG. 7, the sheet sensor S4 is provided near a portion for connecting the conveyance path 24 and the drawer unit 92 and in a downstream side portion of the conveyance path 24. The sheet sensor S5 is provided near a portion for connecting the conveyance path 24 and the drawer unit 92 and at the entrance of the drawer unit 92. The CPU 151, when it detects that jamming has occurred in any of the conveyance paths 24, 43, and 44, stops conveyance of the sheet P. In a case where the sheet P whose conveyance was stopped while spanning the conveyance path 24 and the drawer unit 92, the sheet sensors S4 and S5 both detect the sheet P. Accordingly, the CPU 151, in a case where the sheet sensors S4 and S5 both detect the sheet P, controls the solenoid SL to turn on. By this, the lock member 96 interferes with the projecting portion 95 and rotation of the lever 93 is obstructed. The user opens the door 34 and then removes the sheet P that spans the conveyance path 24 and the drawer unit 92. Then, the CPU 151, when it is recognized that the jamming was resolved based on a result of detection by the sheet sensors S1 and S10, controls the solenoid SL to turn off. By this, the lock member 96 does not interfere with the projecting portion 95 and rotation of the lever 93 is permitted.

Figure 8:
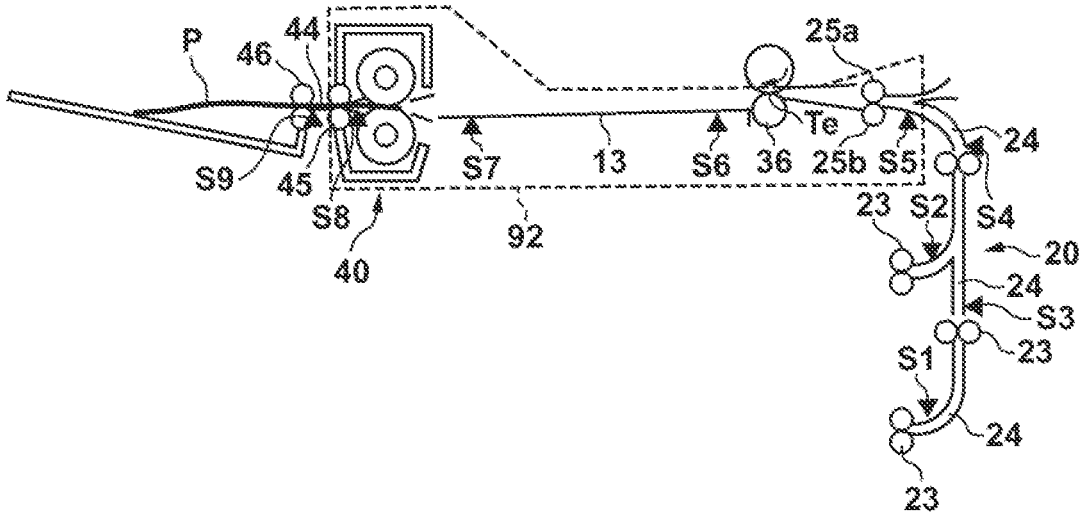
FIG. 8 is a view for describing spanning of a sheet.

As illustrated in FIG. 8, the sheet sensor 59 is provided near a portion for connecting the conveyance path 44 and the drawer unit 92 and in an upstream side portion of the conveyance path 44. The sheet sensor S8 is provided near a portion for connecting the conveyance path 44 and the drawer unit 92 and at the exit of the drawer unit 92. The CPU 151, when it detects that jamming has occurred in any of the conveyance paths 24, 43, and 44, stops conveyance of the sheet P. In a case where the sheet P whose conveyance was stopped while spanning the conveyance path 44 and the drawer unit 92, the sheet sensors S8 and S9 both detect the sheet P. Accordingly, the CPU 151, in a case where the sheet sensors S8 and S9 both detect the sheet P, controls the solenoid SL to turn on. By this, the lock member 96 interferes with the projecting portion 95 and rotation of the lever 93 is obstructed. As illustrated in FIG. 8, the fixing unit 40 has a cylindrical fixing film and a fixing roller. On a rotation axis of the fixing roller, a knob which can be rotated by the user is provided. The user, by opening the front cover 91, can access the knob. By the user manually rotating the knob, the fixing roller also rotates. By the fixing roller rotating, the sheet P that spans the conveyance path 44 and the drawer unit 92 is discharged onto the discharge tray from the discharge port. Then, the CPU 151, when it recognizes that the jamming was resolved based on a result of detection by the sheet sensors S1 and S10, controls the solenoid SL to turn off. By this, the lock member 96 does not interfere with the projecting portion 95 and rotation of the lever 93 is permitted.

Drawer Connectors

Figure 9A:
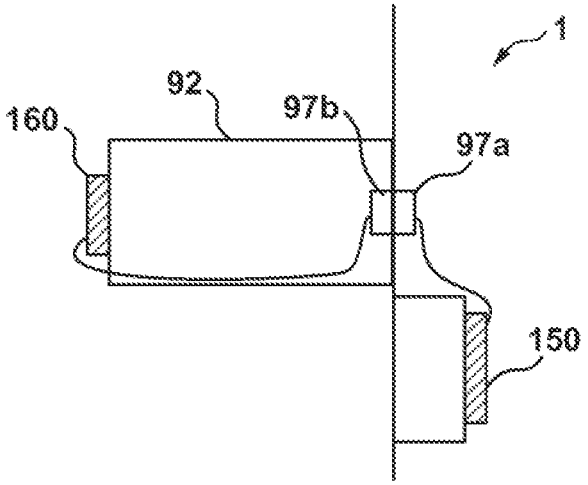
FIGS. 9A and 9B are views describing swapping of a drawer unit.

FIG. 9A illustrates a state in e which the drawer connector 97*b* provided in the drawer unit 92 and the drawer connector 97*a* provided in the main body of the image forming apparatus 1 are connected. When the drawer unit 92 is inserted into the main body of the image forming apparatus 1, the drawer connector 97*a* and the drawer connector 97*b* enter a connected state. By this, the power circuit 155 can supply power in relation to the control substrate 160.

Figure 9B:
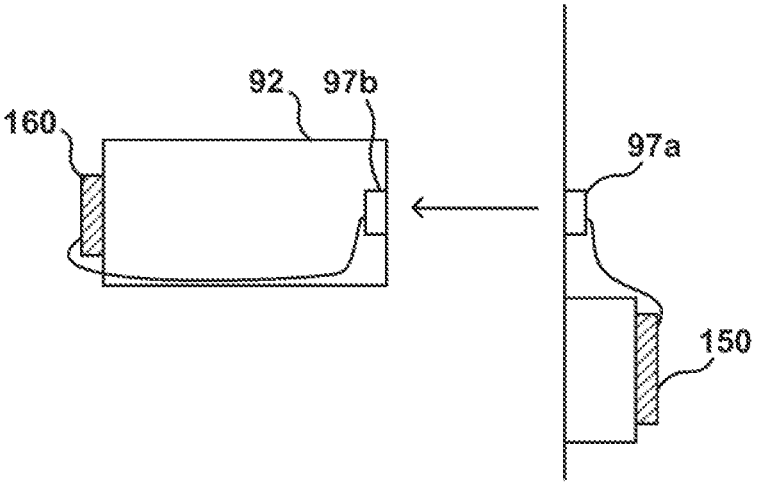

FIG. 9B illustrates a state in which the connection between the drawer connector 97*b* provided in the drawer unit 92 and the drawer connector 97*a* provided in the main body of the image forming apparatus 1 are disengaged. When the drawer unit 92 is pulled out into the main body of the image forming apparatus 1, the drawer connector 97*a* and the drawer connector 97*b* enter a disconnected state. By this, the power circuit 155 cannot supply power in relation to the control substrate 160.

Figures 10A, 10B:
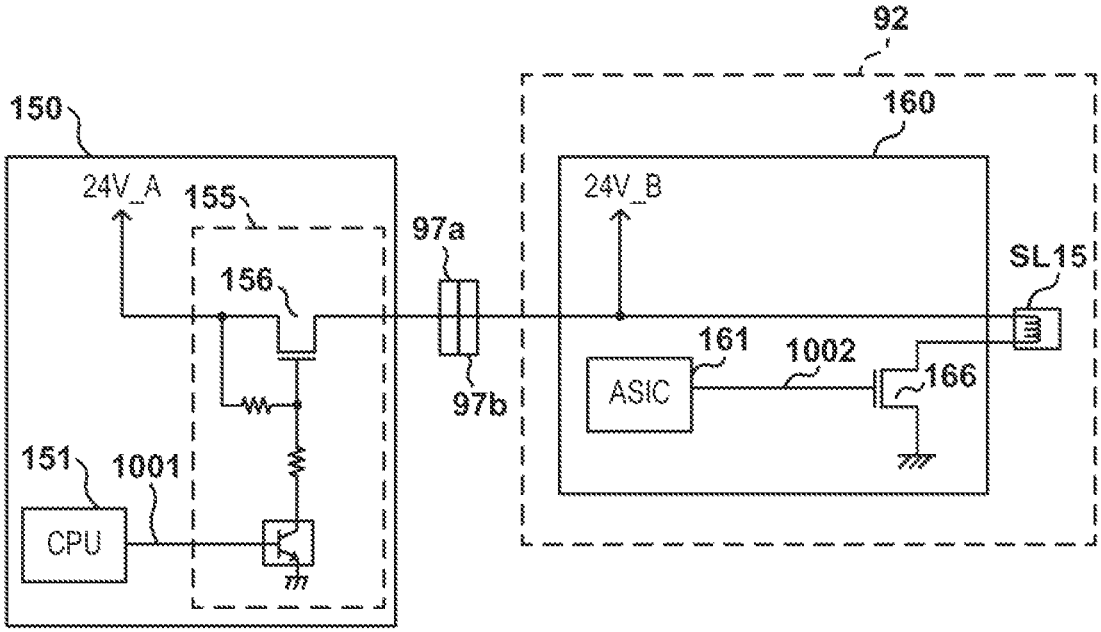
FIGS. 10A and 10B are views describing supplying and disconnection of power.

FIG. 10A illustrates a circuit configuration of the control substrates 150 and 160. The power circuit 155 of the control substrate 150 can supply a voltage of 24V to the control substrate 160. On one terminal of the solenoid SL, an operation voltage of 24V supplied from the control substrate 150 is applied. The other terminal of the solenoid SL is connected to a ground potential via an FET 166 which functions as a switch element. The ASIC 161 of the control substrate 160, by outputting a control signal 1002 to a gate of the FIT 166, turns on and off the solenoid SL.

The power circuit 155 has a FET 156 that controls whether or not to supply the operation voltage of 24V to the control substrate 160. The CPU 151, by outputting a remote signal 1001, controls turning on and off of the FET 156. The CPU 151, based on a detection signal of the cover sensor S11, controls turning on and off of the FET 156.

FIG. 10B is a control table 1003 indicating a remote signal that supports combinations of states of the cover sensor S11 and the drawer unit 92. The control table 1003 is stored in the ROM 152 and is referred to by the CPU 151.

In a state in which the front cover 91 is closed, without depending on whether the drawer unit 92 is locked/unlocked, the CPU 151 turns the remote signal on (High). In a state in which the front cover 91 is open, in order to prevent hot swapping, the CPU 151 generally turns the remote signal off (Low). However, in a case where the front cover 91 is opened when the drawer unit 92 is in the locked state, the CPU 151 maintains the remote signal to be turned on. As described above, in a situation in which the sheet P may be torn, the drawer unit 92 is maintained in the locked state. In order to maintain the looked state of the drawer unit 92, the ASIC 161, the solenoid SL, and the sheet sensors S5 and S8 need power. Thus, the CPU 151, by keeping the remote signal turned on, maintains supply of the operation voltage from the power circuit 155. Also, because the drawer unit 92 is locked and will not be pulled out, hot swapping is prohibited.

Figure 11A:
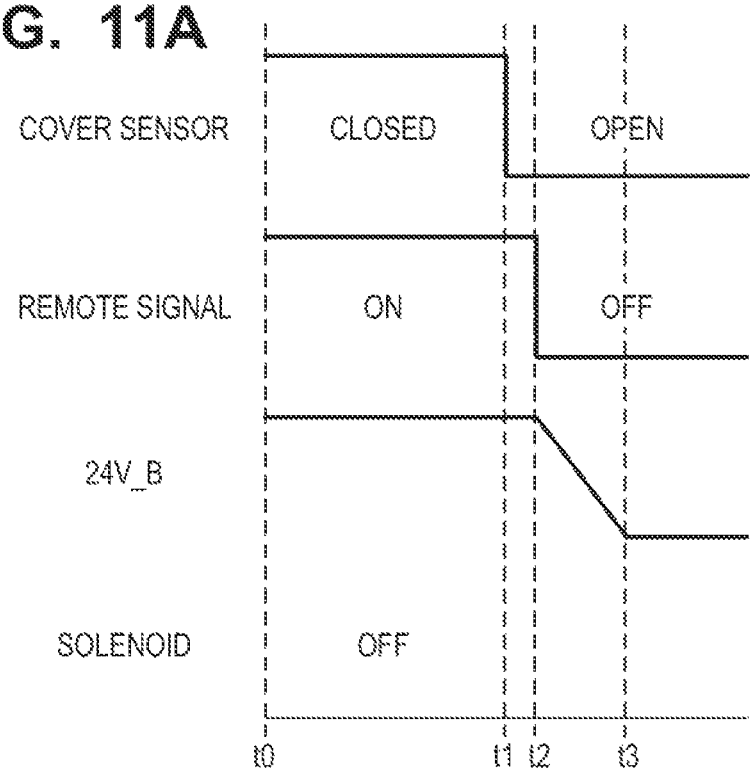
FIGS. 11A and 11B are timing charts indicating various signals.

FIG. 11A illustrates a change in a plurality of signals in a case where the drawer unit 92 is not locked (a state in which the sheet P is not spanning). Although a jam of the sheet P occurred at time t0, the front cover 91 is closed. Thus, the detection signal of the cover sensor S11 indicates that the front cover 91 is closed. Because spanning of the sheet P is not detected, the solenoid SL is kept turned off. As a result, the remote signal is kept turned on, and the power circuit 155 continuously supplies the operation voltage to the control substrate 160.

At time t1, the user opens the front cover 91. Thus, the detection signal of the cover sensor S11 indicates that the front cover 91 is opened.

At time t2, the CPU 151, in order to prevent hot swapping, switches the remote signal from on to off. By this, the power circuit 155 disconnects the supply of the operation voltage to the control substrate 160. At time t3, the operation voltage decreases to 0V. By this, hot swapping is prevented.

Figure 11B:
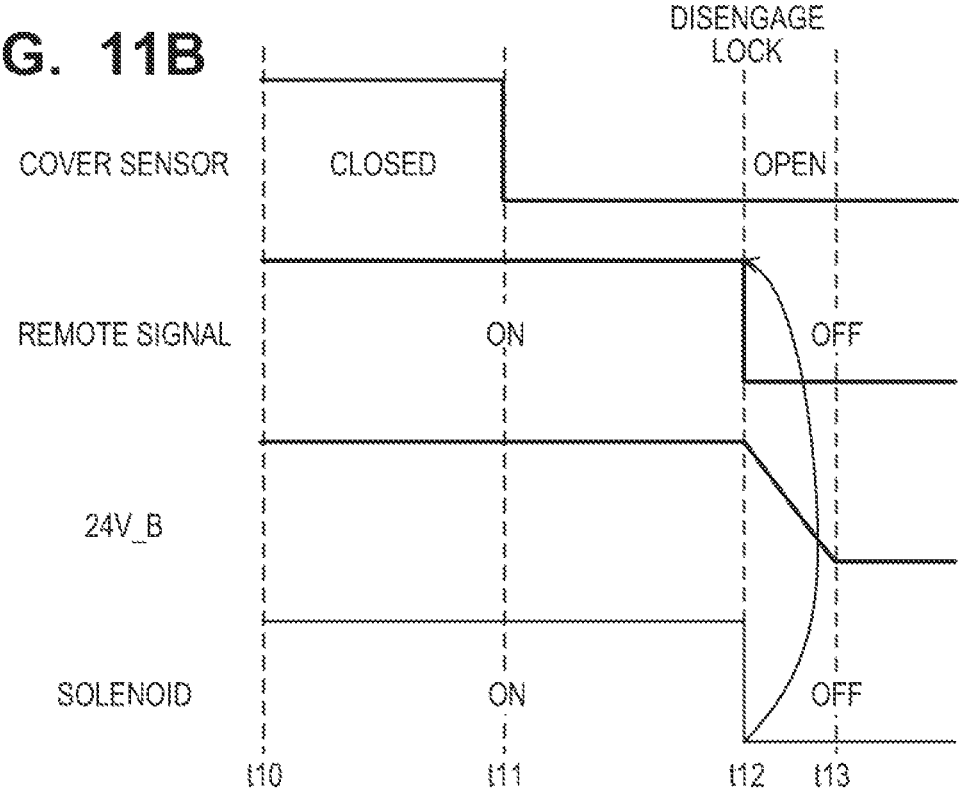

FIG. 11B illustrates a change in a plurality of signals in a case where the drawer unit 92 is locked (a state in which the sheet P is spanning). Although a jam of the sheet P occurred at time t10, the front cover 91 is closed. Thus, the detection signal of the cover sensor S11 indicates that the front cover 91 is closed. Because spanning of the sheet P is detected, the solenoid SL is controlled to turn on. By this, pulling out of the drawer unit 92 is prohibited. The power circuit 155, in order to keep the solenoid SL turned on, continuously supplies the operation voltage to the control substrate 160.

At time t11, the user opens the front cover 91. Thus, the detection signal of the cover sensor S11 indicates that the front cover 91 is open. Because spanning of the sheet P is not detected, the solenoid SL is controlled to continue to be on. The power circuit 155 also continuously supplies the operation voltage to the control substrate 160.

At time t12, it is detected that spanning of the sheet P was resolved, and the solenoid SL is controlled to turn off. By this, pulling out of the drawer unit 92 is permitted. As a result, the remote signal is switched from on to off and supplying of the operation voltage to the control substrate 160 is stopped. At time t13, the operation voltage decreases to 0V. By this, hot swapping is pre rented. By this, in addition to the tearing of the sheet P being prevented, hot swapping is also prevented.

Flowchart

Figure 12:
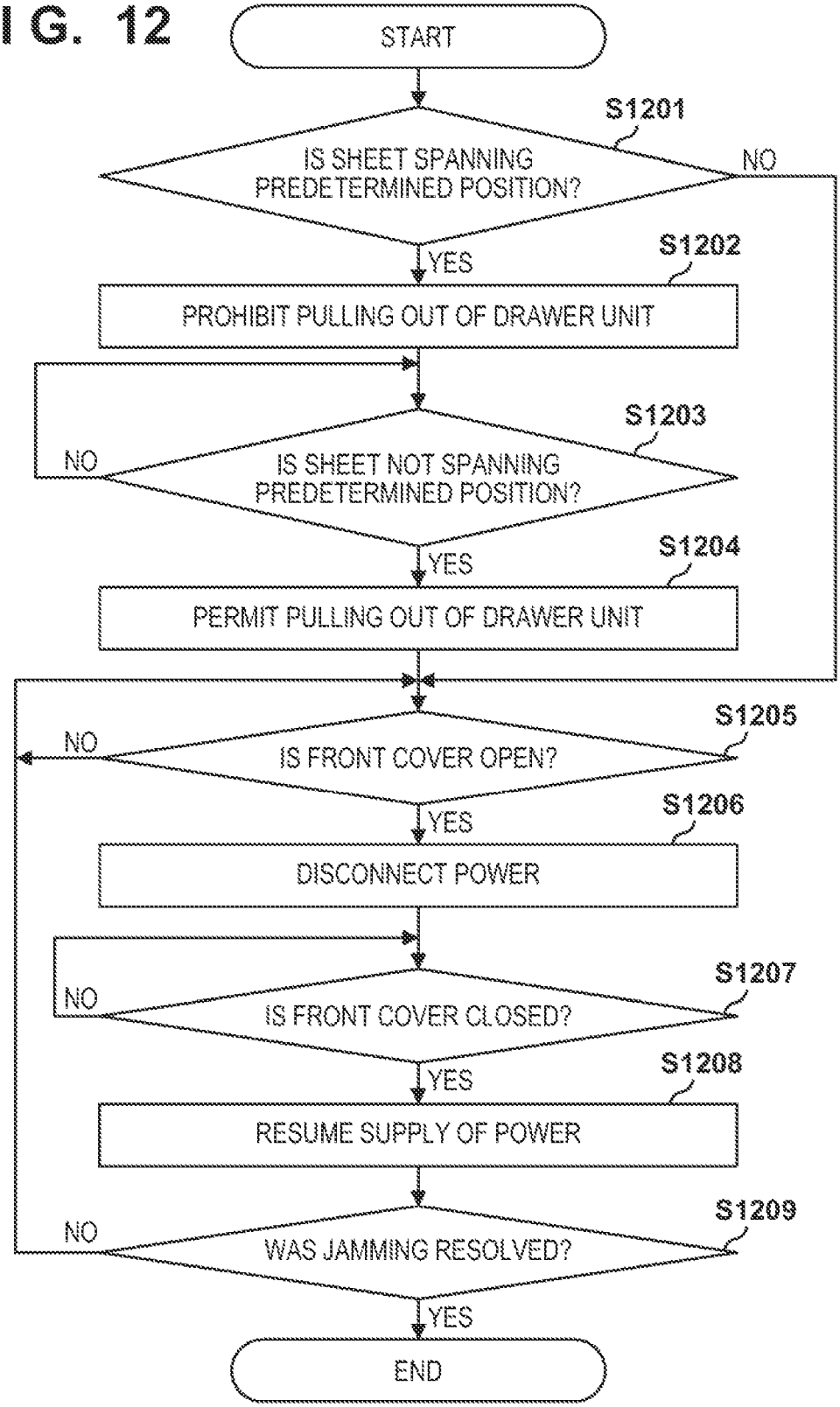
FIG. 12 is a flowchart indicating jam processing.

FIG. 12 illustrates jam processing executed by the CPU 151. The CPU 151 monitors whether or not a jam of the sheet P has occurred based on a result of detection by the sheet sensors S1 to S10. When a jam of the sleet P has occurred, the CPU 151 executes the following processing.

In step S1201, the CPU 151 determines whether or not the sheet P is spanning a predetermined position based on the result of detection by the sheet sensors S4, S5, S8, and S9. The sheet P spanning the predetermined position includes a case where the sheet P spans the conveyance path 24 and the drawer unit 92. The sheet P spanning the predetermined position includes a case where the sheet P spans the conveyance path 44 and the drawer unit 92. In a case where the sheet P does not span the predetermined position, the CPU 151 advances the processing to S1205. Meanwhile, in a case where the sheet P does not span the predetermined position, the CPU 151 advances the processing to S1202.

In step S1202, the CPU 151 prohibits pulling out of the drawer unit 92. For example, the CPU 151 transmits a command signal to the ASIC to turn the solenoid SL. The ASIC 161 turns on the control signal in accordance with the command signal to turn on the solenoid SL via the FET 166. By this, the lock member 96 contacts the projecting portion 95 and prohibits the pulling out of the drawer unit 92.

In step S1203, the CPU 151 determines whether or not the sheet P is not spanning a predetermined position based on the result of detection by the sheet sensors S4, S5, S8, and S9. When the sheet P spanning the predetermined position is removed by the jam processing by the user, the result of detection by the sheet sensors S4, S5, S8, and S9 indicates that there is no sheet. When the sheet P spanning the predetermined position is removed, the CPU 151 advances the processing to step S1204.

In step S1204, the CPU 151 permits (authorizes) the pulling out of the drawer unit 92. The CPU 151 transmits a command signal to the ASIC 161 to turn off the solenoid SL. The ASIC 161 turns off the control signal in accordance with the command signal to turn off the solenoid SL via the FET 166. By this, the lock member 96 makes the projecting portion 95 pivotable and permits the pulling out of the drawer unit 92.

In step S1205, the CPU 151 determines whether or not the front cover 91 is open based on a result of detection by the cover sensor S11. When the front cover 91 is opened, the CPU 151 advances the processing to step S1203.

In step S1206, the CPU 151 disconnects power being supplied to the control substrate 160. For example, the CPU 151 instructs the power circuit 155 to disconnect the supply of power to the control substrate 160. In other words, the CPU 151 switches the remote signal from on to off. When the remote signal switches from on to off, the FET 156 turns off and supplying of power to the control substrate 160 stops. Because the supply of power to the control substrate 160 is disconnected, hot swapping does not occur.

In step S1207, the CPU 151 determines whether or not the front cover 91 is closed based on a result of detection by the cover sensor S11. When the front cover 91 is closed, the CPU 151 advances the processing to step S1208.

In step S1208, the CPU 151 resumes power supply to the control substrate 160. For example, the CPU 151 instructs the power circuit 155 to supply power to the control substrate 160. In other words, the CPU 151 switches the remote signal from off to on. When the remote signal switches from off to on, the rET 156 turns on d resumes the supply of power to the control substrate 160.

In step S1209, the CPU 151 determines whether or not a jam of the sheet P has resolved based on a result of detection by the sheet sensors S1 to S10. If a jam of the sheet P is resolved, the CPU 151 ends the jam processing; meanwhile, if a jam of the sheet P not resolved, the CPU 151 returns the processing to step S1205.

Summary

[Aspect 1]

The conveyance path 24, as illustrated in FIG. 1, is an example of the first conveyance path that conveys a sheet. The drawer unit 92 is an example of a drawer unit that includes the second conveyance path (e.g., conveyance path 43) that conveys a sheet handed over from the first conveyance path and can be pulled out. The power circuit 155 is an example of a power supply that supplies power to the drawer unit. The front cover 91 is an example a door that can be opened/closed. The lock member 96 is an example of a lock unit provided in the drawer unit. The solenoid SL and the lock member 96 have a locked state and an unlocked state. The locked state is state in which the pulling out of the drawer unit is prohibited. when a sheet is spanning the first conveyance path and the drawer unit. The unlocked state is state in which the pulling out of the drawer unit is permitted when a sheet is not spanning the first conveyance path and the drawer unit. The solenoid SL and the lock member 96 maintain the locked state using power supplied to the drawer unit from the power supply. The solenoid SL and the lock member 96 cannot maintain the locked state if the supply of power is disconnected. The CPU 151 is an example of a jam detection unit that detects a sheet jam. The CPU 151, when the sheet jam is detected, also functions as the control unit that stops conveyance of sheets. By this, there are cases where a sheet is spanning the first conveyance path and the drawer unit. In such a case, the CPU 151, without depending on whether the door is in the open state or the closed state, supplies power to the lock unit via the drawer unit from the power supply, and the lock unit is maintained in the locked state. Accordingly, the locked state of the drawer unit 92 is maintained, and tearing of a sheet is prevented. Meanwhile, a sheet may not be spanning the first conveyance path and the drawer unit. In such a case, the CPU 151, in accordance with whether the door is in the closed state or the open state, controls supplying and disconnection of power to the drawer unit from the power supply. In other words, if the door is in the closed state, the CPU 151 controls the power circuit 155 to supply power to the drawer unit from the power supply. If the door is in the open state, the CPU 151 disconnects the supply of power to the drawer unit from the power supply. By this, hot swapping is prevented. By virtue of this embodiment, prevention of tearing of a sheet and prevention of hot swapping by the drawer unit are both achieved.

[Aspect 2]

The sheet sensors S4 and S5 function as the first detection unit (sheet detection unit) that detects a sheet spanning the first conveyance path and the drawer unit. There are cases where a detection signal indicating that a sheet is spanning the first conveyance path and the drawer unit is being outputted from the first detection unit. In such a case, the CPU 151, without depending on whether the door is in the dosed state or the open state, controls supplying of power to the drawer unit from the power supply. There are cases where a detection signal indicating that a sheet is spanning the first conveyance path and the drawer unit is not outputted from the first detection unit. In such a case, the CPU 151, in accordance with whether the door is in the closed state or the open state, controls supplying anal disconnection of power to the drawer unit from the power supply.

[Aspect 3]

The cover sensor S11 functions as a sensing unit that senses if the door is in the open state or if the door is in the closed state. There are cases where a detection signal indicating that a sheet is spanning the first conveyance path and the drawer unit is being outputted from the first detection unit. In such a case, the CPU 151, without depending on the sensing signal outputted by the sensing unit, causes the power supply to supply power to the drawer unit. There are cases where a detection signal indicating that a sheet is spurning the first conveyance path and the drawer unit is not outputted from the first detection unit. In such a case, the CPU 151, in accordance with the sensing signal that the sensing unit outputs, controls supplying and disconnection of power to the drawer unit from the power supply.

[Aspect 4]

The sheet sensor S4 is an example of a first sheet sensor provided in the first conveyance path. The sheet sensor S5 is an example of the second sheet sensor provided in the drawer unit. The CPU 151, in a ease where both the first sheet sensor and the second sheet sensor are detecting a sheet, determines that a sheet is spanning the first conveyance path and the drawer unit. The CPU 151, in a case where at least one of the first sheet sensor and the second sheet sensor is not detecting a sheet, determines that a sheet is not spanning the first conveyance path and the drawer unit.

[Aspect 5]

The conveyance path 44 is an example of a third conveyance path that conveys a sheet handed over from the drawer unit. The lock member 96, when a sheet is spanning the first conveyance path and the drawer unit, or when a sheet is spanning the drawer unit and the third conveyance path, prohibits the pulling out of the drawer unit. The lock member 96, when a sheet is not spanning the first conveyance path and the drawer unit, or when a sheet is not spanning the drawer unit and the third conveyance path, permits the pulling out of the drawer unit. There are cases where a sheet is spanning the first conveyance path and the drawer unit or a sheet may be spanning the drawer unit and the third conveyance path. In such a case, the CPU 151, without depending on whether the door is in the closed state or the open state, controls supplying of power to the drawer unit from the power supply. There are cases where a sheet is not spanning the first conveyance path and the drawer unit and a sheet is not spanning the drawer unit and the third conveyance path. In such a case, the CPU 151, in accordance with whether the door is in the closed state or the open state, controls supplying and disconnection of power to the drawer unit from the power supply.

[Aspect 6]

The sheet sensors S8 and S9 function as the second detection u hat detects a sheet spanning the drawer unit and the third conveyance path. There are cases where a detection signal indicating that a sheet is spanning the third conveyance path and the drawer unit is being outputted from the second detection unit. In such a case, the CPU 151, without depending on whether the door is in the closed state or the open state, controls supplying of power to the drawer unit from the power supply. There are cases where the detection signal indicating that a sheet is not spanning the first conveyance path and the drawer unit and that the sheet is spanning the drawer unit and the third conveyance path is not outputted from the second detection unit. In such a case, the CPU 151, in accordance with whether the door is in the closed state or the open state, controls supplying and disconnection of power to the drawer unit from the power supply.

[Aspect 7]

There are cases where a detection signal indicating that a sheet is spanning the third conveyance path and the drawer unit is being outputted from the second detection unit. In such a case, the CPU 151, without depending on the sensing signal outputted by the sensing unit, causes the power supply to supply power to the drawer unit. There are cases where a sheet is not spanning the first conveyance path and the drawer unit and that the detection signal indicating that the sheet is spanning the drawer unit and the third conveyance path is not outputted from the second detection unit. In such a case, the CPU 151, in accordance with the sensing signal that the sensing unit outputs, controls supplying and disconnection of power to the drawer unit from the power supply.

[Aspect 8]

The sheet sensor S8 is an example of the third sheet sensor provided in the drawer unit. The sheet sensor S9 is an example of the third conveyance path provided in the fourth sheet sensor. In a case where the third sheet sensor and the fourth sheet sensor both are detecting a sheet, the CPU 151 determines that a sheet is spanning the drawer unit and the third conveyance path. The CPU 151, in a case where at least one of the third sheet sensor and the fourth sheet sensor is not detecting a sheet, determines that a sheet is not spanning the third conveyance path and the drawer unit.

[Aspect 9]

The drawer connector 97*a* is an example of a first connector provided in the image forming apparatus. The drawer connector 97*b* is an example of the second connector provided in the drawer unit. The second connector, when the drawer unit is pulled out from the image forming apparatus, is detached from the first connector, and when the drawer unit is inserted into the image forming apparatus, engages the first connector. The power supply (e.g., power circuit 155) supplies power to the lock unit (e.g., solenoid SL) via the first connector and the second connector.

[Aspect 10]

There are cases where the drawer unit has a locking member (e.g., projecting portion 95) that switches, in coordination with movement of the lever 93, between a locked state in which locking is performed in relation to the image forming apparatus 1 and an unlocked state in which locking is not performed in relation to the image forming apparatus 1. In other words, the lever 93 switches between the locked state and the unlocked state with regard to the locking member. The lock unit (e.g., lock member 96), by obstructing the movement of the lever or the locking member, maintains the drawer unit in the closed state.

[Aspect 11]

The lever and the locking member may be attached to the same rotation axis (e.g., rotation axis 94). The lever, the locking member, and the rotation axis may be integrated.

[Aspect 12]

The solenoid SL operates by the power supplied to the drawer unit. The lock member 96 is driven by the solenoid SL, and when the solenoid SL turns on, may obstruct (interfere with) the movement of the lever or the locking member. The lock member 96 may permit the movement of the lever and the locking member when the solenoid is turned off.

[Aspect 13]

The control unit (e.g., CPU 151), when a sheet jam is detected, may control the lock mechanism (e.g., solenoid SL and lock member 96) as follows. There are cases where a detection signal indicating that a sheet is spanning the first conveyance path and the drawer unit is being outputted from a detection unit. In such a case, the CPU 151, by continuing to supply power to the drawer unit from the power supply, causes the lock mechanism to prohibit the pulling out of the drawer unit. When the detection signal indicating that a sheet spanning the first conveyance path and the drawer unit ceases to be there is outputted from the detecting unit, the CPU 151 causes the lock mechanism to permit the pulling out of the drawer unit. There are cases where after a sheet spanning the first conveyance path and the drawer unit ceases to be there, the sensing unit outputs the sensing signal indicating that the door was opened. In such a case, the CPU 151 disconnects the supply of power to the drawer unit from the power supply. There are cases where sensing unit outputs the sensing signal indicating that the opened door was closed. In such a case, the CPU 151 resumes the supply of power to the drawer unit from the power supply.

Although the rotational drawer lock mechanism 90 was described in the embodiment, this is merely an example. For example, a lock mechanism having a lever that can move up and down, a spring biasing the lever in a downward direction, and a projecting portion that is moved to a lock position by the lever may be employed. In such a case, the user, by raising the lever in an upward direction against the biasing force of the spring, moves the projecting portion to an unlocked position. Note that the lock member may be provided so as to obstruct movement of the projecting portion and the lever in an upward direction. The solenoid SL moves the lock member between an obstructed position and a permitted position. By this, pulling out of the drawer unit 92 is inhibited. In a case Where the lock member is in a permitting position, movement of the projecting portion and the lever in the upward direction is permitted. Specifically, pulling out of the drawer unit 92 is permitted. Note that the lock mechanism may be modified so that the lever moves in a left-right direction. The lever is biased in a leftward direction by the spring and the projecting portion is held at the lock position. The user, by moving the lever in a rightward direction against the biasing force of the spring, moves the projecting portion to an unlocked position. Note that the lock member and the solenoid SL may be provided so as to obstruct movement of the projecting portion and the lever in a rightward direction.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise ore or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-044388, filed Mar. 13, 2020, which is hereby incorporated by reference herein in its entirety.

What is claimed is:

1. An image forming apparatus comprising:

a first conveyance path cc figured to convey a sheet;

a drawer unit including a second conveyance path for conveying the sheet, after the sheet is handed over from the first conveyance path, and configured to be able to be pulled out;

a power supply configured to supply power to the drawer unit;

a door configured to be able to be opened/closed;

a lock unit which is provided in the drawer unit, which has locked state in which pulling out of the drawer unit is prohibited in a case where a sheet is spanning the first conveyance path and the drawer unit and an unlocked state in which pulling out of the drawer unit is permitted in a case where a sheet is not spanning the first conveyance path and the drawer unit, and which is configured to maintain the locked state using power supplied to the drawer unit from the power supply, and which is configured not to maintain the locked state when a supply of the power is disconnected;

a jam sensor configured to detect a sheet jam; and a processor configured to, when the sheet jam is detected, in a case where a sheet is spanning the first conveyance path and the drawer unit, without depending on whether the door is in the open state or the closed state, maintain the lock unit in the locked state by supplying power to the lock unit via the drawer unit from the power supply, and in a case where a sheet is not spanning the first conveyance path and the drawer unit, control supplying and disconnecting of power to the drawer unit from the power supply in accordance with whether the door is in a closed state or an open state.

2. The image forming apparatus according to claim 1, further comprising:

a first sensor circuit configured to detect a sheet spanning the first conveyance path and the drawer unit, wherein the processor, in a case where a detection signal indicating that a sheet is spanning the first conveyance path and the drawer unit is being outputted from the first sensor circuit, without depending on whether the door is in an open state or a closed state, maintains the lock unit in the locked state by supplying power to the drawer unit from the power supply, and in a case where a detection signal indicating that a sheet is spanning the first conveyance path and the drawer unit is not being outputted from the first sensor circuit, controls supplying and disconnecting of power to the drawer unit from the power supply in accordance with whether the door is in an open state or a closed state.

3. The image forming apparatus according to claim 2, further comprising:

a door sensor configured to sense that the door is in an open state or that the door is in a closed state, wherein the processor, in a case where a detection signal indicating that a sheet is spanning the first conveyance path and the drawer unit is being outputted front the first sensor circuit, without depending on a sensing signal that the door sensor outputs, maintains the lock unit in the locked state by supplying power to the drawer unit from the power supply, and in a case where a detection signal indicating that a sheet is spanning the first conveyance path and the drawer unit is not being outputted from the first sensor circuit, controls supplying and disconnecting of power to the drawer unit from the power supply in accordance with the sensing signal that the door sensor outputs.

4. The image forming apparatus according to claim 3, wherein the first sensor circuit includes:

a first sheet sensor provided in the first conveyance path; and a second sheet sensor provided in the drawer unit, and the processor in a case where both of the first sheet sensor and the second sheet sensor are detecting a sheet, determines that the sheet is spanning the first conveyance path and the drawer unit, and in a case where at least one of the first sheet sensor and the second sheet sensor is not detecting a sheet, determines that the sheet is not spanning the first conveyance path and the drawer unit.

5. The image forming apparatus according to claim 3, further comprising:

a third conveyance path configured to convey a sheet handed over from the drawer unit, wherein the lock unit, when a sheet is spanning the first conveyance path and the drawer unit or when a sheet is spanning the drawer unit and the third conveyance path, enters a locked state in which pulling out the drawer unit is prohibited, and when a sheet is not spanning the first conveyance path and the drawer unit and when a sheet is not spanning the drawer unit and the third conveyance path, enters a unlocked state in which pulling out the drawer unit is permitted, and the processor, when a sheet is not spanning the first conveyance path and the drawer unit and when a sheet is not spanning the drawer unit and the third conveyance path, without depending on whether the door is in an open state or closed state, maintains the lock unit in the locked state by supplying power to the drawer unit from the power supply, and when a sheet is not spanning the first conveyance path and the drawer unit and when a sheet is not spanning the drawer unit and the third conveyance path, controls supplying and disconnecting of power to the drawer unit from the power supply in accordance with whether the door is in a closed state or an open state.

6. The image forming apparatus according to claim 5, further comprising:

a second sensor circuit configured to detect a sheet spanning the drawer unit and the third conveyance path, wherein the processor, in a case where a detection signal indicating that a sheet is spanning the drawer unit and the third conveyance path is being outputted from the second sensor circuit, without depending on whether the door is in an open state or a closed state, maintains the lock unit in the locked state by supplying power to the drawer unit from the power supply, and in a case where a detection signal indicating that a sheet is not spanning the first conveyance path and the drawer unit and a sheet is spanning the drawer unit and the third conveyance path is not being outputted from the second sensor circuit, without depending on whether the door is in an open state or closed state, controls supplying and disconnection of pox per to the drawer unit from the power supply.

7. The image forming apparatus according to claim 6, wherein the processor, in a case where a detection signal indicating that a sheet is spanning the drawer unit and the third conveyance path is being outputted from the second sensor circuit, without depending on a sensing signal that the door sensor outputs, maintains the lock unit in the locked state by supplying power to the drawer unit from the power supply, and in a case where a detection signal indicating that a sheet is not spanning the first conveyance path and the drawer unit and a sheet is spanning the drawer unit and the third conveyance path is not being outputted from the second sensor circuit, controls supplying and disconnection of power to the drawer unit from the power supply in accordance Leith the sensing signal that the door sensor outputs.

8. The image forming apparatus according to claim 6, wherein the second sensor circuit includes:

a third sheet sensor provided in the drawer unit, and a fourth sheet sensor provided in the third conveyance path, and wherein the processor, in a case where both of the third sheet sensor and the fourth sheet sensor are detecting a sheet, determines that the sheet is spanning the drawer unit and the third conveyance path, and in a case where at least one of the third sheet sensor and the fourth sheet sensor is not detecting a sheet, determines that the sheet is not spanning the drawer unit and the third conveyance path.

9. The image forming apparatus according to claim 1, further comprising:

a first connector provided in the image forming apparatus; and a second connector which is provided in the drawer unit and which, when the drawer unit is pulled out from the image forming apparatus, is detached from the first connector, and when the drawer unit is inserted into the image forming apparatus, engages the first connector, wherein the power supply, via the first connector and the second connector, supplies power to the lock unit.

10. The image forming apparatus according to claim 1, wherein the drawer unit further includes:

a locking member for which a locked state in which locking is performed in relation to the image forming apparatus and an unlocked state in which no locking is performed in relation to the image forming apparatus are switched; and a lever configured to switch the locked state and the unlocked state for the locking member, and the lock unit, by obstructing the movement of the lever or the locking member in the locked state, maintains the drawer unit in the closed state.

11. The image forming apparatus according to claim 10, wherein the lever and the locking member are attached to a common rotation axis.

12. The image forming apparatus according to claim 10, wherein the lock unit includes:

a solenoid configured to operate by power supplied from the drawer unit; and a lock member configured to be driven by the solenoid, and obstruct movement of the lever or the locking member when the solenoid is turned on and permit movement of the lever and the locking member when the solenoid is turned off.

13. An image forming apparatus comprising:

a first conveyance path configured to convey a sheet;

a drawer unit including a second conveyance path for conveying the sheet, after the sheet is handed over from the first conveyance path, and configured to be able to be pulled out;

a power supply configured to supply power to the drawer unit;

a sheet sensor circuit configured to detect a sheet spanning the first conveyance path and the drawer unit;

a door configured to be able to be opened closed;

a door sensor configured to be able to sense opening/closing of the door;

a lock mechanism which is provided in the drawer unit, and configured to prohibit pulling out of the drawer unit in a case where a sheet is spanning the first conveyance path and the drawer unit and configured to permit pulling out of the drawer unit in a case where a sheet is not spanning the first conveyance path and the drawer unit;

a jam sensor configured to detect a sheet jam; and a processor configured to, when the sheet jam is detected, in a case where a detection signal indicating that a sheet is spanning the first conveyance path and the drawer unit is being outputted from the sheet sensor, without depending on whether the door is an open state or a closed state, cause the lock mechanism to prohibit pulling out of the drawer unit by continuing to supply power to the drawer unit from the power supply, when a detection signal indicating that a sheet spanning the first conveyance path and the drawer unit is eliminated is being outputted from the sheet sensor, cause the lock mechanism to permit pulling out of the drawer unit, in a case where, after a sheet spanning the first conveyance path and the drawer unit ceases to span the first conveyance path and the drawer unit, the door sensor is outputting a sensing signal indicating that the door as opened, a supply of power to the drawer unit from the power supply is disconnected, and in a case where the door sensor outputs a sensing signal indicating that the door, which had been open, is closed, to resume supplying of power to the drawer unit from the power supply.

* * * * *